United States Patent [19]

Bruney, III

[11] 4,439,644

[45] Mar. 27, 1984

[54] LOUD SPEAKER ENCLOSURE

[75] Inventor: Paul F. Bruney, III, New Orleans, La.

[73] Assignee: Edmund M. Jaskiewicz, Washington, D.C. ; a part interest

[21] Appl. No.: 324,412

[22] Filed: Nov. 24, 1981

[51] Int. Cl.[3] ..... G10K 13/00

[52] U.S. Cl. ..... 179/146 E; 181/151; 181/199

[58] Field of Search ..... 179/1 E, 146 E; 181/199, 146, DIG. 1, 151

[56] References Cited

U.S. PATENT DOCUMENTS

| | | | |
|---|---|---|---|
| 2,121,008 | 6/1938 | Bilhuber | 179/146 E |
| 2,713,396 | 7/1955 | Tavares | 181/199 |
| 2,991,840 | 7/1961 | Van Camp | 181/151 |
| 3,430,729 | 3/1969 | Dunning | 181/151 |
| 3,757,890 | 9/1973 | Dunning | 179/146 E |
| 4,101,736 | 7/1978 | Czerwinski | 181/151 |
| 4,127,751 | 11/1978 | Kinoshita | 181/151 |
| 4,161,995 | 7/1979 | Pohlmann | 181/199 |
| 4,227,051 | 10/1980 | Thomas | 179/1 E |
| 4,284,844 | 8/1981 | Belles | 179/1 E |
| 4,301,332 | 11/1981 | Dusanek | 179/146 E |

FOREIGN PATENT DOCUMENTS

| | | | |
|---|---|---|---|
| 791127 | 12/1935 | France | 181/151 |
| 856899 | 11/1952 | France | 181/151 |
| 512610 | 9/1939 | United Kingdom | 181/151 |

*Primary Examiner*—G. Z. Rubinson
*Assistant Examiner*—L. Schroeder
*Attorney, Agent, or Firm*—Edmund M. Jaskiewicz

[57] ABSTRACT

A loudspeaker enclosure has a loudspeaker driver mounted on a surface of the enclosure such that the driver has an exposed front face to produce sound waves which are sought to be transmitted to a listening space exterior of the loudspeaker enclosure. A plurality of successive spaced limp or semi-limp non-porous pliable barriers are positioned in an opening between the interior and exterior spaces of the enclosure so as to relieve rear pressure of the loudspeaker driver while attenuating the rear sound waves and providing a damping effect on the loudspeaker driver.

12 Claims, 6 Drawing Figures

LOUD SPEAKER ENCLOSURE

The present invention relates to enclosures for loudspeaker drivers, more particularly to such a disclosure utilizing one or more limp masses as sound barriers to relieve pressure behind the loudspeaker driver while attenuating the rear sound wave.

Many forms of loudspeaker enclosures of different sizes, shapes and configurations have been developed in an attempt to provide loudspeaker systems which would reproduce sound with a fidelity as near as possible to the original sound which was recorded. These loudspeaker enclosures have been proposed in order to enable the loudspeaker driver to perform optimally without low frequency acoustic cancellation between front and rear wave outputs of the loudspeaker driver. The numerous attempts to achieve this objective have involved essentially only two basic enclosure constructions which may be designated as either a terminating enclosure or a resonant enclosure. These essentially basic constructions have further been embellished with many modifications such as unloading.

A terminating enclosure, which may also be described as an acoustic suspension enclosure, mounts the loudspeaker driver in a totally sealed rigid enclosure. This structure isolates the loudspeaker driver rear sound wave from the exterior environment surrounding the enclosure and the front sound wave transmitted from the driver. This enclosure thus prohibits acoustic cancellation of lower frequency information. However, as speaker excursion increases, the volume of air within the enclosure becomes increasingly pressurized and depressurized. The pressurization of the air produces a resistance to loudspeaker driver motion which increases with amplitude. The result is an amplitude compression of the reproduced audio signal. In addition, because the enclosure is rigid, the enclosed volume of air functions as a spring and, when coupled with the mass of the loudspeaker driver, resonates at some frequency.

In larger enclosures of this type such as the "infinite baffle" enclosures, the spring effect is not as pronounced as in the smaller acoustic suspension constructions in which the spring effect is used as a supplemental mechanical suspension for the loudspeaker driver. In the smaller enclosures, the compression effect of the enclosed air on the loudspeaker driver results in a greater "flattening" of the sound field. Since human depth perception relies substantially upon signal amplitudes, there is an increased loss of detail in the reproduced audio signal.

In a resonant enclosure, the rear sound wave from the loudspeaker driver is vented to the environment exterior of the enclosure by means of a suitably designed labyrinth or port. This construction relieves pressure behind the loudspeaker driver while using the resonant port to phase invert the rear wave at some optimum frequency. The phase inverted rear wave is then used to reinforce the front sound wave from the loudspeaker driver at that particular frequency. Acoustically, this type of enclosure permits the loudspeaker driver to reproduce higher frequencies with greater clarity, but lower frequencies are "blurred" and "muddy" because of the acoustic action of the port or labyrinth. In resonant enclosure structures which are less successful, the mechanical damping action of the enclosure on the loudspeaker driver may be inadequate so as to create "wooly" or "loose" low frequency reproduction.

It was then proposed to provide a loudspeaker enclosure in which the rear wall was formed by a sheet of rubber or other resilient material. This flexible wall was intended to reduce the compression and rarefaction of the air mass behind the loudspeaker in an attempt to increase the efficiency of the system. However, the stretched sheet of flexible material which was further stretched in and out by the outward and inward movements of the cone of the loudspeaker combined to place a load on the cones of loudspeakers mounted in the enclosure so as to adversely affect the sound reproduction characteristics of the enclosure.

It was next proposed in U.S. Pat. No. 3,554,313 issued Jan. 12, 1971 to provide a thin, slack, lightweight, essentially nonresilient easily movable backing member behind the loudspeaker driver in such a manner so as to form an air chamber which moves in response to rear sound waves from the driver and which effectively contains such rear waves to prevent their escape into the listening area. This backing member was arranged in such a manner that it would not collapse against the rear of the loudspeaker driver, nor would the backing member stretch tight or become rigid because of the compression of the air mass within the space enclosed by the flexible backing member. Not only was this flexible member mounted to enclose the rear portion of the loudspeaker driver, but it could also be arranged to form a loose surface or rear wall of the loudspeaker enclosure behind the driver. However, this single layer of limp, thin backing material could only function to contain rear sound waves from the driver and prevent their escape into the intended listening area when the sound waves are of high frequency. Since only higher frequencies can be attenuated by a light mass such as the thin material disclosed in this patent, it was apparent that this construction was not intended for use in lower frequency ranges where comparatively greater barrier masses would be necessary. Thus, low frequency attenuation could not be achieved by this previously disclosed construction, nor would this thin backing member provide any damping action on the moving cone of the loudspeaker driver.

It is, therefore, the principal object of the present invention to provide an improved enclosure for a loudspeaker driver which is capable of high fidelity reproduction of sound.

It is another object of the present invention to provide a loudspeaker enclosure which relieves pressure behind the loudspeaker driver while attenuating the rear sound wave, which isolates the rear sound wave of the driver from the environment surrounding the enclosure, which allows uncompressed motion of the loudspeaker driver and which applies a non-resonant damping effect to the motion of the driver.

It is a further object of the present invention to provide a loudspeaker enclosure which utilizes limp pliable masses as sound barriers so as to relieve pressure behind a loudspeaker driver while attenuating the rear sound wave.

The resonant back pressure and blurring problems which have existed in prior art enclosures as described above are solved by the enclosure of the present invention wherein the loudspeaker driver is mounted in an enclosure which utilizes a plurality of successive spaced, limp, non-porous, pliable barriers between the interior and exterior spaces of the enclosure so as to relieve pressure behind the loudspeaker driver while attenuating the rear sound waves and providing a damping effect on the loudspeaker driver.

It has been discovered that a limp or semi-limp pliable mass is more effective as a sound barrier than a rigid barrier of equivalent mass which functions essentially like a piston. Being limp and pliable, the barrier is free to move so as to relieve back pressure on the loudspeaker driver while attenuating the rear sound wave. This pressure relief within the enclosure prevents the resilient behavior of the air within the enclosure while at the same time produces a damping effect on the motion of the loudspeaker driver.

According to one aspect of the present invention, an enclosure for a loudspeaker driver is adapted for the mounting of a loudspeaker driver which has an exposed front face to produce sound waves to be transmitted to a listening space exterior of the loudspeaker enclosure. A plurality of successive spaced limp, non-porous barriers are mounted in an opening in the enclosure between the interior and exterior spaces of the enclosure.

The enclosure according to the present invention removes existent limiting factors and provides a greater level of control to loudspeaker driver performance. The enclosure permits the loudspeaker driver to function in the manner for which it was designed by providing an environment that readily satisfies requirements necessary for the proper propagation of a faithfully reproduced sound wave. These requirements are essentially the attenuation of the rear sound wave, release of back pressure behind the driver, and non-resonant damping of the driver. Since the driver is free to respond to subtle amplitude changes in the signal, low frequency air movement will be reproduced with much greater accuracy to thus provide a more complete and accurate picture to the brain of the listener of the original sound source. In addition, the size of the loudspeaker enclosure no longer dictates operating parameters for the loudspeaker driver. As a result, loudspeaker systems can be constructed to achieve very low frequencies at high amplitudes from much smaller enclosures than is presently considered possible in the known state of the art. An additional advantage resulting from freeing the driver of pressurization is greater efficiency of the driver.

Other objects and advantages of the present invention will be apparent in reference to the accompanying description when taken in conjunction with the following drawings, which are exemplary, wherein.

Figure 2:
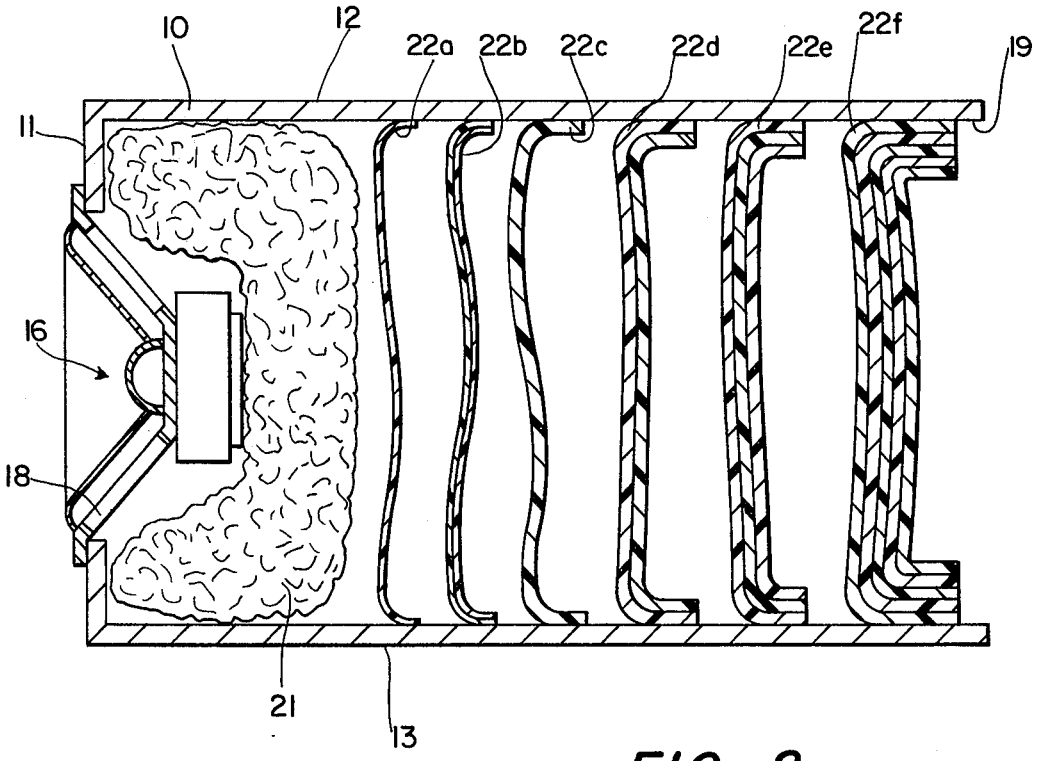
FIG. 2 is a sectional view taken along the line II—II of FIG. 1.
Figure 2A:
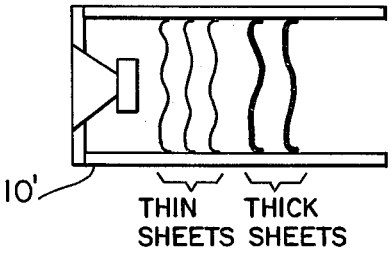
Figure 2B:
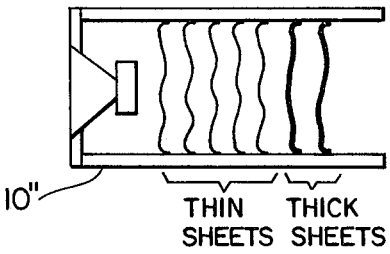
Figure 3:
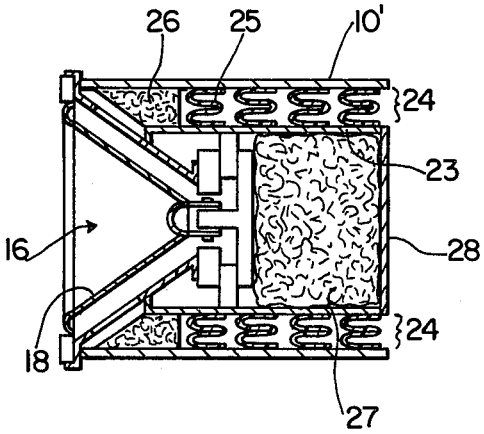
Figure 4:
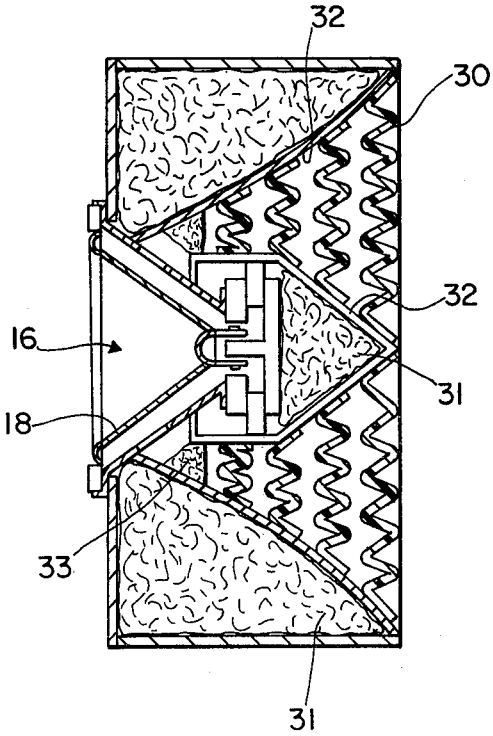

FIG. 2*a* is a view similar to that of FIG. 2 of a loudspeaker requiring damping beginning at a relatively high frequency;

FIG. 2*b* is a view similar to that of FIG. 2 of a loudspeaker requiring damping beginning at a relatively low frequency;

FIG. 3 is a view similar to that of FIG. 2 but showing a modification thereof; and FIG. 4 is a view similar to that of FIG. 2 but showing further modification.

Proceeding next to the drawings wherein like reference symbols indicate the same parts throughout the various views, a specific embodiment and modifications of the present invention will be described in detail.

Figure 1:
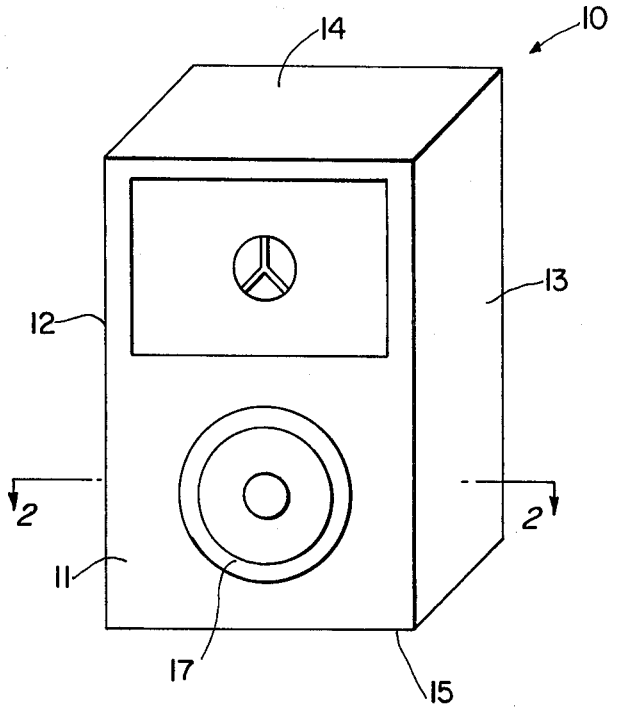
FIG. 1 is an overall perspective view of a loudspeaker enclosure according to the present invention.

In FIG. 1, there is indicated generally at 10 a loudspeaker enclosure according to the present invention. The enclosure 10 has five rigid sides or faces consisting of a front face 11, side walls 12 and 13, a top wall 14 and a bottom wall 15. A loudspeaker driver 16 is mounted to the inner surface of front wall 11 so that a front face 17 of the driver is exposed to produce sound waves to be transmitted to a listening space exterior of the loudspeaker enclosure. The driver also has a cone 18 which is directed to an open rear face 19 of the enclosure as may be seen in FIG. 2.

In this embodiment, the loudspeaker driver comprises a low frequency driver consisting of an 8 inch woofer.

The open face 19 of the enclosure thus defines an opening between the interior 20 of the enclosure and the exterior of the enclosure which consists of all the space and environment surrounding the enclosure.

As may be seen in FIG. 2, sound absorbent material 21 such as fiberglass, dacron, wool and the like may be provided within the enclosure 10 and behind the loudspeaker driver 16 so as to discourage sound reflections within the enclosure.

The sixth or open face 19 of the enclosure is closed by a plurality of successive spaced, limp, non-porous pliable barriers which in this embodiment comprise six barriers 22*a*, 22*b*, 22*c*, 22*d*, 22*e* and 22*f*. These pliable barriers are fastened to the inner surfaces of the enclosure so that no air leaks exist at the fastening seams, and the barriers are thus positioned between the interior and exterior spaces of the enclosure. Each barrier preferably consists of one or more sheets of vinyl since vinyl is not too flexible and has a memory. Further, vinyl behaves somewhat as a thick liquid.

A plurality of successively spaced barriers as illustrated in FIG. 2 is preferable when the loudspeaker driver reproduces a wide range of frequency. The barriers or layers of sheets of vinyl are of a progressively increasing thickness and spaced at substantially equal distances. The first barrier 22*a* consists of two sheets of vinyl each sheet being 12 mils thick for a total barrier thickness of 24 mils.

The structure and total thickness of each of the barriers in the embodiment of FIG. 2 are as follows:

22*a*—2 sheets 12 mil vinyl—24 mils
22*b*—3 sheets 12 mil vinyl—36
22*c*—1 sheet 40 mil vinyl—40
22*d*—2 sheets 40 mil vinyl—80
22*e*—3 sheets 40 mil vinyl—120
22*f*—5 sheets 40 mil vinyl—200

The barriers are spaced from each other at a minimum distance at which there is no contact between adjacent barriers during flexing or bending thereof. The distances between successive barriers should be substantially equal in most cases. The maximum distance between successive barriers is limited by the number of barriers to be used and the dimensions of the enclosure in which the barriers are to be mounted.

In addition, the barriers may also be spaced progressively further away from the loudspeaker driver. This arrangement of multiple barriers provides progressive pressure release behind the loudspeaker driver as frequency of the reproduced signal decreases.

The vinyl sheet barriers 22*a–f* are limply suspended or mounted to permit uncompressed motion of the loudspeaker driver, but at the same time to apply a damping effect to the motion of the loudspeaker driver.

The stiffness of a vinyl sheet is proportional to the thickness of the vinyl sheet. It is this stiffness which provides the damping (resistance to motion) to the loudspeaker driver. However, it is the mass of the vinyl barriers which provides the attenuation for sound. Hence, many thin sheets can provide the equivalent attenuation as can fewer thicker sheets. The important difference is that even though the attenuation is the same, fewer thicker sheets provide more damping than the many thin sheets.

As frequency decreases, the penetration of sound through massive barriers increases (thus requiring increased mass for equivalent attenuation). This is a feature of the progressive thickness approach. The progressive thickness ratio of successive barriers and initial sheet thickness are determined by considering the "Q" and the frequency range of the driver. These properties determine how much damping is required (i.e., the thickness of the thicker vinyl) and at what point in the frequency range should damping be applied (i.e., how many thin sheets and of what thickness are to be placed between the driver and the thicker sheets).

In FIG. 2*a*, there is shown a loudspeaker which requires damping beginning at a relatively high frequency. A few thin sheets provide some attenuation of higher frequencies, but allow lower frequencies to pass to thick sheets. The thickness of these sheets will provide only mild damping for these higher frequencies. The thickness of the thick sheets is selected for damping effect depending on the characteristics of the particular loudspeaker.

In FIG. 2*b*, there is shown a loudspeaker which requires damping beginning at a lower frequency. More thin sheets are used to provide greater attenuation of high frequencies. The frequencies passed by this thin sheet stage are lower than the thin sheet stage of the FIG. 2*a* example, i.e., damping of the thicker sheets is not engaged until a lower frequency is reached. The thickness of the thick sheets is again selected for damping effect depending on the characteristics of the loudspeaker used.

In both FIG. 2*a* and FIG. 2*b*, the thickness of each sheet is progressively increased for smooth transition.

The plurality of successive barriers as shown in FIG. 2*b*, which is particularly suitable for low frequencies, can be acoustically coupled to the loudspeaker driver over a path length of many feet because of the length of the sound waves involved and the increasing penetration ability of sound waves with progressively lower frequency. The use of multiple densities and stiffnesses of the barriers enables progressively lower frequencies produced by the moving loudspeaker driver to be progressively damped.

It is apparent from the above that both the initial sheet thickness and the thickness ratio of the barriers are values which are dependent on the characteristics and application of the particular loudspeaker driver.

In FIG. 3, there is illustrated a modification wherein the enclosure 10 is cylindrical or may be elongated with a square or rectangular cross section. The cross sectional area of a passage 23 which extends rearwardly from the outwardly facing portion of the cone 18 of the loudspeaker driver. Within the passage 24 there is positioned a plurality of spaced, successive, pliable barriers 25 preferably consisting of several sheets of vinyl and having a thickness of approximately 80–200 mils. The barriers 25 are convoluted or provided with sinuous folds in order to permit maximum excursion in a limited area. The relative stiffness of the pliable barriers, their close proximity to each other and the differences in surface area between the cone 18 and the barriers 25 create an increased damping effect on the motion of the cone 18. Absorbent material 26 is positioned immediately to the rear of the cone 18 so as to discourage sound reflections in the region of the cavity near the loudspeaker cone. Additional sound absorbent material 27 fills the sealed cavity behind the loudspeaker driver so as to discourage internal resonances. This internal passage 23 is closed off or sealed at its outer end by a rigid wall 28.

In FIG. 4, there is shown a modification which further increases the damping effect of the barriers on the cone. This modification utilizes hornloading in order to couple the stiffness and inertial mass of a very large area of limp mass barriers 30 to the much smaller surface area at the rear of the loudspeaker driver 16. The space behind the driver 16 is filled with sound absorbent material 31 and the same similar absorbent material is also positioned outside of the angled surfaces 32 which define the horn structure. Absorbent material 33 is similarly positioned behind the cone so as to perform the same function as the sound absorbent material in the embodiment of FIG. 2.

Similar to the structure of FIG. 3, the pliable barriers 30 are provided with convolutions and are spaced successively in a direction away from the loudspeaker driver. The barriers 30 are each about 80–200 mils in thickness.

Both the modifications of FIGS. 3 and 4 may employ progressively increasing thicknesses and stiffnesses of the pliable mass materials for selective damping at different frequencies as illustrated in FIG. 1.

According to the present invention, two or more faces of the loudspeaker enclosure are formed by the pliable limp masses. The enclosure is spherical and the opening between the interior and the exterior of the enclosure is closed by a plurality of successively spaced pliable masses as described herein. The enclosure may be in the shape of a polyhedron and all of the faces, except for the face upon which is mounted the driver, can be constructed of pliable limp masses as described above.

The overall efficiency of the loudspeaker enclosure, according to the present invention, is readily apparent from tests made in an anechoic chamber using an audio spectrometer with a condensor microphone. For the first test, a loudspeaker system which is available on the market was used, and this loudspeaker system included a low frequency driver consisting of an eight-inch CTS woofer, an original crossover network and the original acoustic suspension enclosure. The tweeter, which was part of this loudspeaker system, was disconnected for the test. The low frequency driver (LFD) of this loudspeaker system has a relatively smooth output from 50 hertz to 3,500 hertz having a variation of plus or minus 5 decibels.

A second test was then run utilizing the same LFD and the same crossover network, but the enclosure was modified in accordance with the present invention. The curve again showed a smooth output of the LFD between 60 hertz and 3,300 hertz having a variation of plus or minus 5 decibels. However, the downward slope of the LFD response curve showed a very significant difference. From 25 hertz to 50 hertz, the low frequency plateau was about 14 decibels lower than the remainder of the systems response, this plateau can be raised by the addition of more modified stages.

A second significant difference is the relative efficiency of both systems. With 2.6 volts RMS input, the original system delivered a sound pressure level of 75 decibels. However, the modified system, using the same 2.6 volts RMS input, delivered a sound pressure level of 85 decibels. This improved overall efficiency is due to the more ideal environment provided for the woofer by the enclosure modified according to the present invention. Not only has the efficiency been increased, but the compromises previously associated with each of the enclosure types as described above have been minimized. By applying the present invention to enclosures, damping can be applied to the low frequency driver without the spring-like compression effect of acoustic suspension enclosures or the resonant boosting effect of most other open type enclosures as discussed above.

Thus it can be seen that the present invention has disclosed a loudspeaker which attenuates low frequency sounds emanating from the rear of the cone and utilizes the internal friction of the limp material (its slight "stiffness") to produce a nonresonant damping effect on the motion of the cone.

It will be understood that this invention is susceptible to modification in order to adapt it to different usages and conditions and, accordingly, it is desired to comprehend such modifications within this invention as may fall within the scope of the appended claims.

What is claimed is:

1. An enclosure for a loudspeaker driver comprising means for defining an enclosure having an interior space and adapted for the mounting of a loudspeaker driver having an exposed front face to produce sound waves to be transmitted to a listening space exterior of the loudspeaker enclosure, said enclosure means having at least one opening between the interior and exterior spaces thereof, and a plurality of successive spaced limp nonporous barriers to seal said opening between the interior and exterior spaces of the enclosure to relieve pressure behind the loudspeaker driver while attenuating the rear sound waves.

2. An enclosure as claimed in claim 1 and comprising a plurality of faces and one of said faces comprising said opening.

3. An enclosure as claimed in claim 1 and having five rigid faces, one of said faces being adapted for mounting a loudspeaker driver therein and said opening being opposed from said one face.

4. An enclosure as claimed in claim 1 wherein the enclosure means comprises a plurality of faces and each face comprises at least one limp barrier.

5. An enclosure as claimed in claim 1 wherein said barriers each comprises at least one vinyl sheet.

6. An enclosure as claimed in claim 5 wherein each of said barriers has a thickness ranging from 12–200 mils.

7. An enclosure for a loudspeaker driver comprising means for defining an enclosure having an interior sapce and adapted for the mounting of a loudspeaker driver having an exposed front face to produce sound waves to be transmitted to a listening space exterior of the loudspeaker enclosure, said enclosure means having at least one opening between the interior and exterior spaces thereof, and a plurality of successive spaced limp nonporous barriers between the interior and exterior spaces of the enclosure to relieve pressure behind the loudspeaker driver while attenuating the rear sound waves, and said barriers are of progressively increasing thickness in a direction away from a said driver.

8. An enclosure as claimed in claim 7 wherein the first barrier after the driver has a thickness of 12 mils.

9. An enclosure for a loudspeaker driver comprising means for defining an enclosure having an interior space and adapted for the mounting of a loudspeaker driver having an exposed front face to produce sound waves to be transmitted to a listening space exterior of the loudspeaker enclosure, said enclosure means having at least one opening between the interior and exterior spaces thereof, and a plurality of successive spaced limp nonporous barriers between the interior and exterior spaces of the enclosure to relieve pressure behind the loudspeaker driver while attenuating the rear sound waves and means for defining a first passage extending rearwardly from said driver, means for defining a second passage concentric to said first passage and extending rearwardly from a cone of a said driver, said barriers being disposed within said second passage.

10. An enclosure as claimed in claim 9 wherein the area of said first passage is less than the area of said second passage.

11. An enclosure as claimed in claim 9 wherein said barriers have convolutions therein.

12. An enclosure as claimed in claim 1 and further comprising means for defining a horn loading structure at the rear of said driver, said barriers being disposed behind said driver within said horn loading structure means.

* * * * *